United States Patent [19]

Kehoe et al.

[11] Patent Number: 5,036,542

[45] Date of Patent: Jul. 30, 1991

[54] AUDIO SURVEILLANCE DISCOURAGEMENT APPARATUS AND METHOD

[76] Inventors: Brian D. Kehoe, 1409-B G St., NE., Washington, D.C. 20002; Noel D. Matchett, 1001 Spring St., #505, Silver Spring, Md. 20910

[21] Appl. No.: 430,356

[22] Filed: Nov. 2, 1989

[51] Int. Cl.[5] ..... H04R 3/02

[52] U.S. Cl. ..... 381/73.1; 380/6

[58] Field of Search ..... 381/73.1; 380/6

[56] References Cited

U.S. PATENT DOCUMENTS

| | | |
|---|---|---|
| 2,107,756 | 2/1938 | Kendall et al. . |
| 2,400,950 | 5/1946 | Puringtor . |
| 2,401,889 | 6/1946 | Smith . |
| 2,405,599 | 8/1946 | Mitchell . |
| 2,988,598 | 6/1961 | Enikeieff . |
| 3,638,123 | 1/1972 | Sicard et al. . |
| 3,980,827 | 9/1976 | Sepmeyer et al. . |
| 4,010,324 | 3/1977 | Jarvis et al. . |
| 4,054,751 | 10/1977 | Calder et al. . |
| 4,438,526 | 3/1984 | Thomalla . |
| 4,674,124 | 6/1987 | Horrall et al. . |

*Primary Examiner*—Forester W. Isen

*Attorney, Agent, or Firm*—Armstrong, Nikaido, Marmelstein, Kubovcik & Murray

[57] ABSTRACT

An audio surveillance discouragement apparatus or system comprising, at least, first generating device, second generating device, first speaker and second speaker. The first speaker is coupled to the first generating device, and the second speaker is coupled to the second generating device. The first generating device generates a first signal having a plurality of voice signals, synthesized vocal signals, and dummy intelligence signals, mixed with an audio frequency spectrum, which is approximately divided into a plurality of frequency bands with each of the frequency bands randomly and independently increasing or decreasing in volume, and may have a 20 dB pocket near 500 Hz. The second generating device generates a second signal which is nonsynchronous with the first signal. The second signal is identical in construction to the first signal, but is unique in identity and characteristics. Additional signals are constructed in the same manner and generated in the same manner. The first speaker radiates the first signal. The second speaker radiates the second signal. Additional speakers radiate additional signals. All speakers are located a distance from each other for spatially mixing the radiated signals.

20 Claims, 4 Drawing Sheets

TYPICAL SECTION OF COMPOUND WAVEFORM WITH IRREGULAR AMPLITUDE AND FREQUENCY PEAKS AND VARIATIONS

AUDIO SURVEILLANCE DISCOURAGEMENT APPARATUS AND METHOD

BACKGROUND OF THE INVENTION

The present invention relates to the generation of noise or interference signals, and more particularly pertains to generating audio noise in a controlled manner such that reproduction of a specific noise characteristics is impossible.

DESCRIPTION OF THE PRIOR ART

In the prior art, atmospheric noise synthesizers using random noise generators have been disclosed having three outputs. Sickard et al., U.S. Pat. No. 3,638,123, issued Jan. 25, 1972, discloses a synthesizer using variable level clipper and amplifiers. Similarly, U.S. Pat. No. 3,980,827 issued to Sepmeyer et al., issued Sept. 14, 1976 illustrates a noise masking system utilizing first and second noise generators, narrowband equalizers connected to the noise generators, and a combiner connector to the channels to produce a third output. Also, U.S. Pat. No. 4,010,324 to Jarvis et al. issued Mar. 4, 1977 discloses a noise generator and equalizer connected to a plurality of time delays. In the prior art, general techniques include random noises for masking audio signals or other noises in a particular environment.

Prior art techniques have not disclosed or taught apparatus or system which has particular advantages for discouraging and masking voice signals, by taking advantage of particular characteristics of voice or other target signals.

OBJECTS AND SUMMARY OF THE INVENTION

An object of the invention is to provide a system which will mask an acoustic target, such as a voice or voices, and/or any acoustic sound which may contain intelligence.

Another object of the present invention is a system using a specially constructed masking signal which will render an acoustic target signal unintelligible, and extremely difficult, if not impossible, to isolate from the masking signal.

A still further object of the invention is to provide a device which will discourage or foil ambient room bugging during sensitive or classified telephone conversations or face-to-face conversations, and during intelligence bearing sound transmissions.

According to the present invention, as embodied and broadly described herein, an audio surveillance discouragement apparatus or system is provided comprising first generating means, second generating means, first speaker means and second speaker means. Additional generating and speaker means are preferable in one embodiment of the invention. The first speaker means is coupled to the first generating means, and the second speaker means is coupled to the second generating means. The first generating means generates a first signal having a plurality of voice signals, synthesized vocal signals, and dummy intelligence signals mixed with audio frequency spectrum which is divided approximately into a plurality of frequency bands with each of the frequency bands randomly and independently increasing or decreasing in amplitude. The first speaker means radiates the first signal.

The second generating means generates a second signal which is nonsynchronous with the first signal.

The second signal has a plurality of voice signals, synthesized vocal signals, and dummy intelligence signals mixed with audio frequency spectrum which is divided approximately into a plurality of frequency bands with each of the frequency bands randomly and independently increasing or decreasing in amplitude. The second speaker means radiates the second signal. The first speaker means and the second speaker means are located a distance from each other for spatially mixing the radiated first signal with the radiated second signal.

The first generating means may be embodied as a first tape player, the second generating means may be embodied as a second tape player, the first speaker means may be embodied as a first speaker, and the second speaker means may be embodied as a second speaker. Alternatively, the first and second generating means may be embodied as a stereo tape player having the first signal on the first track of the stereo tape player and the second signal on a second track of the stereo tape player.

A second preferred embodiment of the invention includes a method of discouraging audio surveillance which comprises the steps of generating a first signal having a plurality of voice signals, synthesized vocal signals and dummy intelligence signals, mixed with an audio frequency spectrum which is divided into a plurality of frequency bands randomly and independently increasing or decreasing in amplitude. The first signal is radiated using first speaker means. The method further includes generating a second signal nonsynchronous with the first signal, with the second signal a plurality of voice signals, synthesized vocal signals and dummy intelligence signals, mixed with an audio frequency spectrum which is divided into a plurality of frequency bands randomly and independently increasing or decreasing in amplitude. Additionally, the steps include radiating the second signal in a room at at distance from the first signal such that the first signal and the second signal mix in the spatial environment. The steps may include generating and radiating additional signals which are similar to the first and second signals.

Additional objects and advantages of the invention will be set forth in part in the description which follows, and in part will be obvious from the description, or may be learned by practice of the invention.

BRIEF DESCRIPTION OF THE DRAWINGS

The accompanying drawings, which are incorporated in and constitute a part of this specification, illustrate a preferred embodiment of the invention, and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
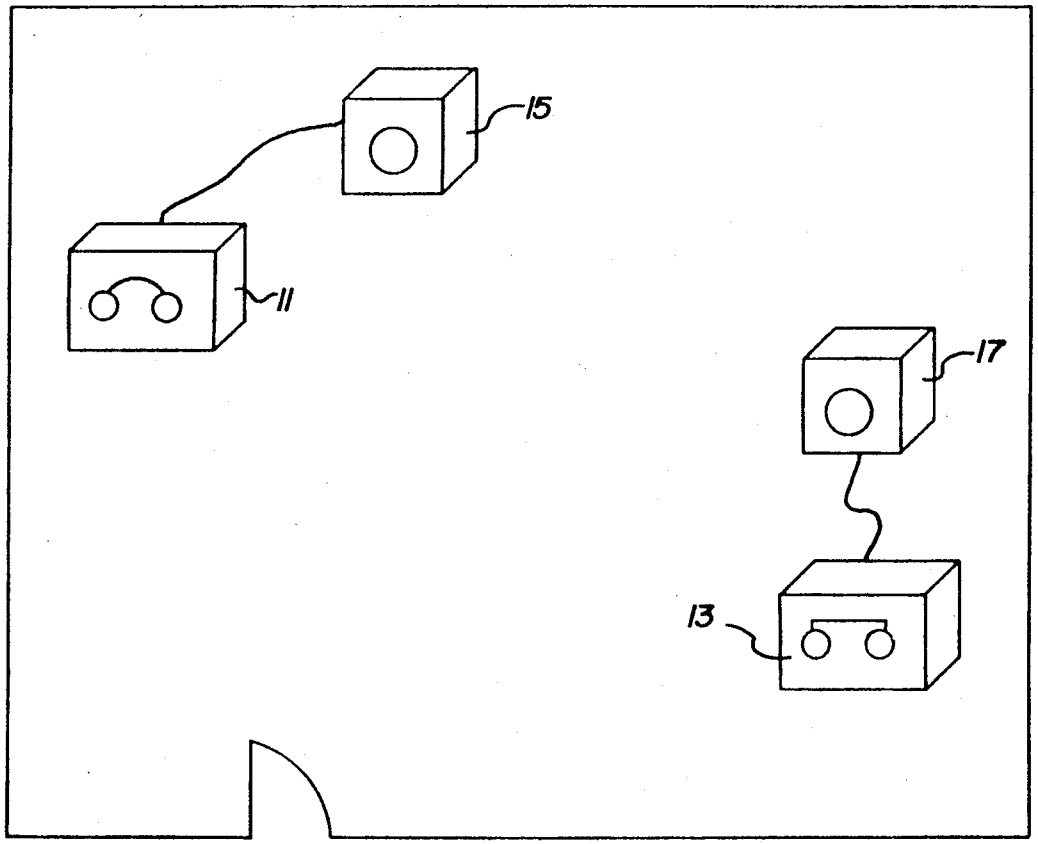
FIG. 1 illustrates a preferred embodiment of the present invention.

As illustratively shown in FIG. 1, an audio surveillance discouragement apparatus or system is provided comprising first generating means, second generating means, first speaker means and second speaker means. The first speaker means is coupled to the first generating means, and the second speaker means is coupled to the second generating means. Additional generating means and speaker means are preferable, and are coupled in the same fashion as the first and second generating means and the first and second speaker means, respectively.

In the exemplary arrangement shown, first generating means may be embodied as a first tape recorder/-player 11, second generating means may be embodied as a second tape recorder/player 13, first speaker means may be embodied as a first speaker 15, and second speaker means may be embodied as a second speaker 17. The first speaker 15 is coupled to the first tape recorder/player 11, and the second speaker 17 is coupled to the second tape recorder/player 13.

The first tape recorder/player 11 generates a first signal. The first signal may include a plurality of voice signals, synthesized vocal signals, and dummy intelligence signals, mixed with an audio frequency spectrum. The audio frequency spectrum is characterized as pink noise, which may have a pocket of 20 dB at approximately 500 Hz, and which is divided into a plurality of frequency bands, with each of the frequency bands randomly and independently increasing or decreasing in amplitude. The first speaker 15 which is coupled to the first tape recorder/player 11 radiates the first signal as an audio signal into an environment.

The second tape recorder/player 13 generates a second signal, which is nonsynchronous with the first signal. The second signal may include a plurality of voice signals, synthesized vocal signals, and dummy intelligence signals, mixed with an audio frequency spectrum. The audio frequency spectrum is characterized as pink noise, which has a pocket of 20 dB at approximately 500 Hz, and which is divided into a plurality of frequency bands, with each of the frequency bands randomly and independently increasing or decreasing in amplitude. The second speaker 17 is coupled to the second tape recorder/player 13, and radiates the second signal. In a preferred embodiment, the first speaker 15 is located a distance from the second speaker 17 for spatially mixing the radiated first signal with the radiated second signal.

A second preferred embodiment of the invention includes a method of discouraging audio surveillance which comprises the steps of generating a first signal having a plurality of voice signals, synthesized vocal signals and dummy intelligence signals, mixed with an audio frequency spectrum. The audio frequency spectrum includes pink noise, which may have a pocket of 20 dB at approximately 500 Hz, and which is divided into a plurality of frequency bands, with each of the frequency bands randomly increasing and decreasing in amplitude. The first signal is radiated using the first speaker means. The method further includes generating a second signal nonsynchronous with the first signal, with the second signal having a plurality of voice signals, synthesized vocal signals and dummy intelligence signals, mixed with an audio frequency spectrum. The audio frequency spectrum includes pink noise, which may have a pocket of 20 dB at approximately 500 Hz, and which is divided into a plurality of frequency bands, with each of the frequency bands randomly increasing and decreasing in amplitude. Additionally, the steps include radiating the second signal, using second speaker means, in a room at at distance from the first signal, radiated by first speaker means, such that the first signal and the second signal mix in the spatial environment.

A third preferred embodiment of the invention comprises a method for discouraging audio surveillance which comprises the steps of filling a magnetic disk, CD-ROM, or other digital or computer oriented format with a plurality of voice signals, synthesized vocal signals, dummy intelligence signals, and audio frequency spectra which have been approximately divided into a plurality of frequency bands, each of which have been randomly and independently increased or decreased in amplitude. The method further includes the incorporation of a program on the magnetic disk, CD-ROM or other format such that one, two, or preferably more signals are assembled from the plurality of all other signal samples, generated and output as first, second, and additional signals. While the signals are generated and radiated, new signals are assembled for output. This process continues ad infinitum, for the duration of need. The first speaker radiates the first signal, the second speaker radiates the second signal, and additional speakers radiate any additional signals. Additionally, the steps include radiating all of the signals in a room at a distance from each other, such that all of the signals mix in the spatial environment.

The method and apparatus of the present invention foil electronic listening devices, or "bugs." Specifically, the present invention masks an acoustic target signal, e.g., a voice or voices, conversation or intelligence-bearing communication, and/or any acoustic sound which may contain intelligence. A specially constructed masking signal is acoustically generated/reproduced for the duration of the acoustic target signal, so as to render the acoustic target signal unintelligible, and extremely difficult, if not impossible, to isolate.

The invention comprises at least the first and second signals, which are acoustic masking signals, generated according to a special noise formula and played back through acoustic speakers for the duration of the acoustic target signal. Generation, storage, and playback of the first and second signals may be in any format—magnetic tape, magnetic disc, compact disc, digital audio tape, or RAM sampling chip, as examples—the format is determined primarily by playback circumstances.

The two or more independent acoustic masking signals generated according to the noise formula are nonrepetitive and nonsynchronous, thus assuring the uniqueness of each playback. The noise formula is based in part upon relevant psychoacoustic properties, and designed to exploit to the maximum the differences between the human ear and electronic listening devices. The noise formula for each channel is an approximately even mix of a first signal and a second signal, which are described below.

Figure 4:
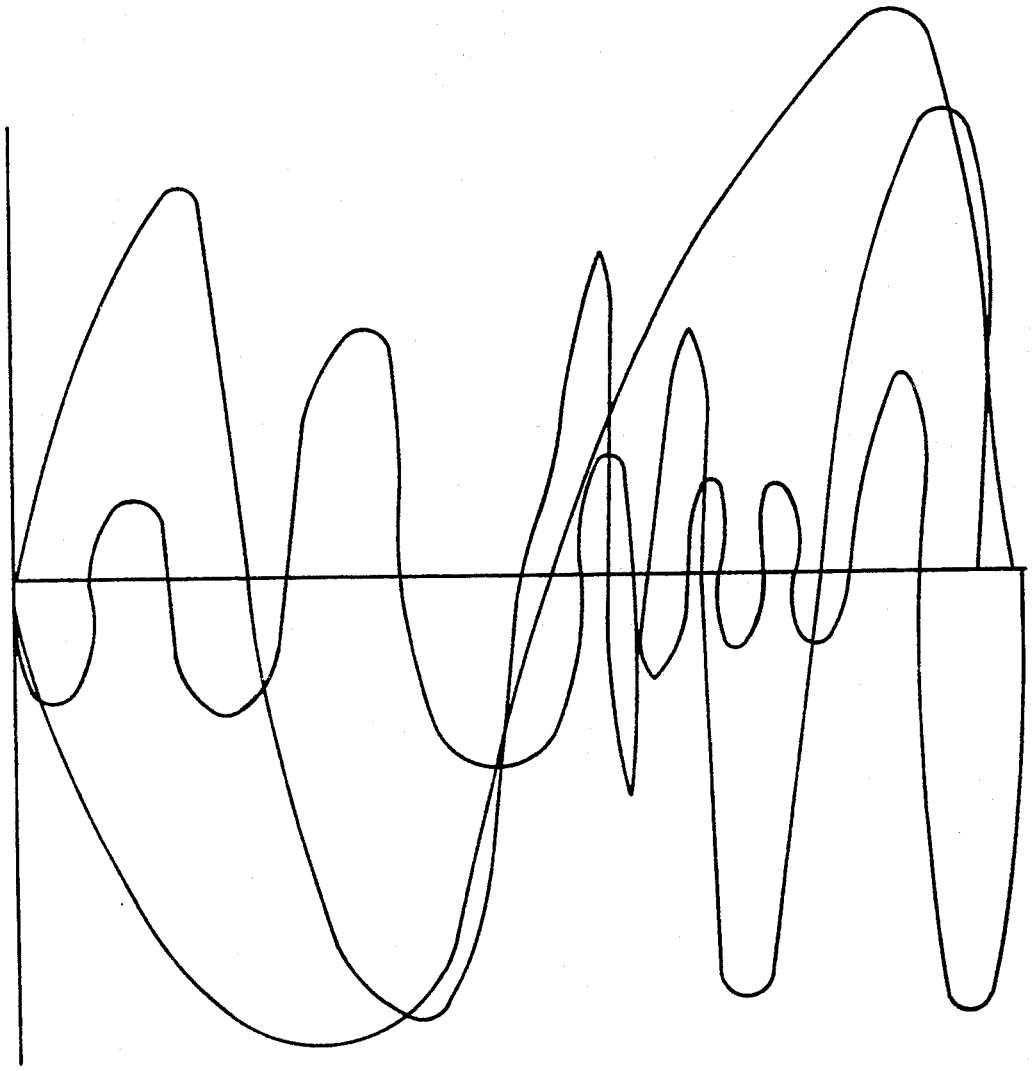
FIG. 4 illustrates a typical section of compound waveforms with irregular amplitude and frequency peaks and variations.

The first and second signals are an irregular, varying mix of the following:

1. One or more, ideally many more, simultaneously active voices, which may or may not be related to the target signal, voice or voices, of varying gender and range, as shown in FIG. 4.

Figure 2:
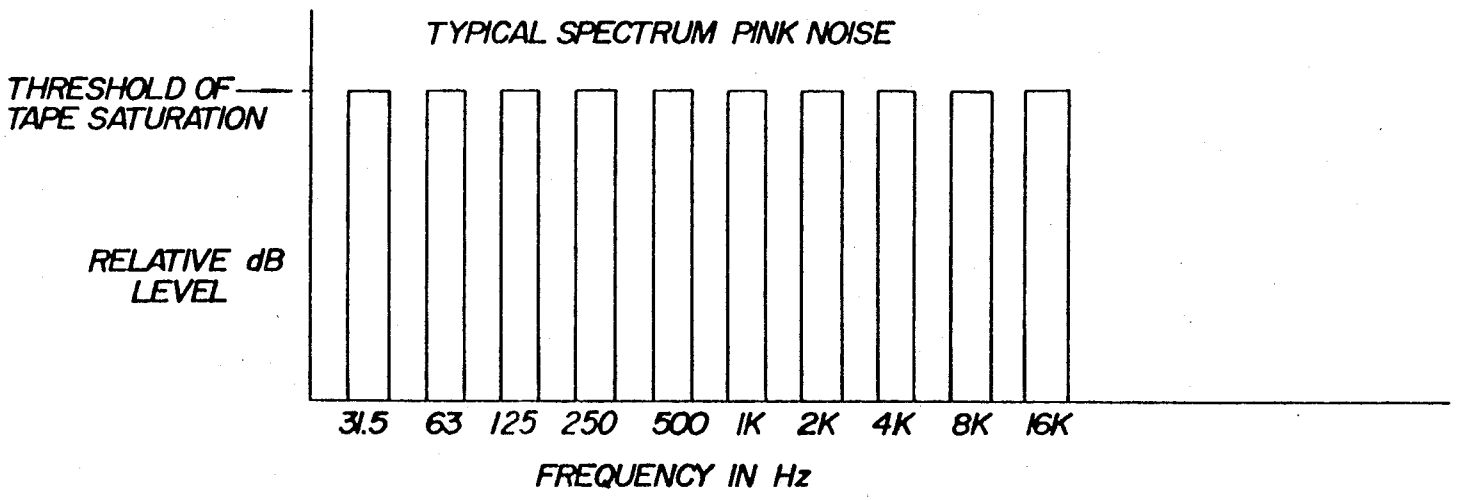
FIG. 2 illustrates a typical spectrum of pink noise.
Figure 3A:
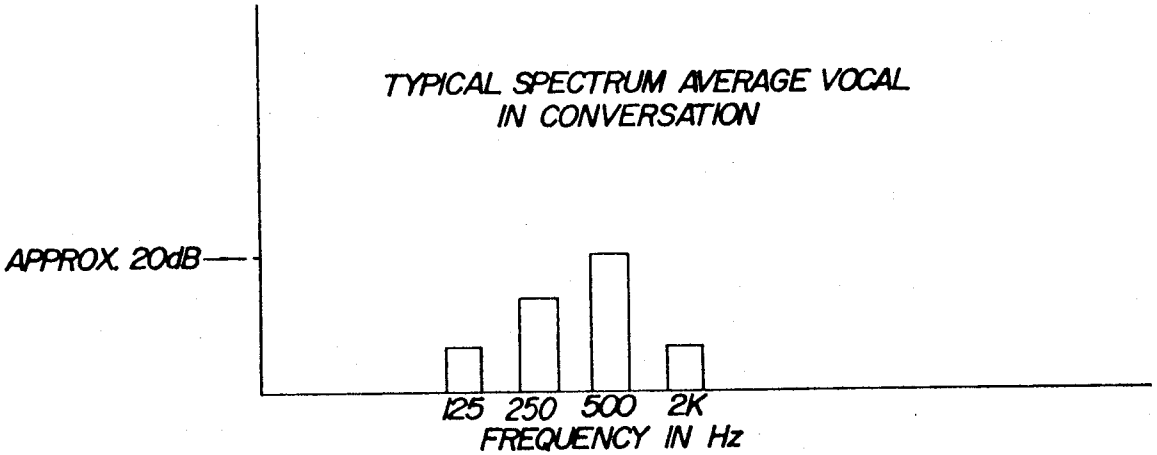
FIG. 3A illustrates a typical spectrum of average vocal signal in conversations.
Figure 3B:
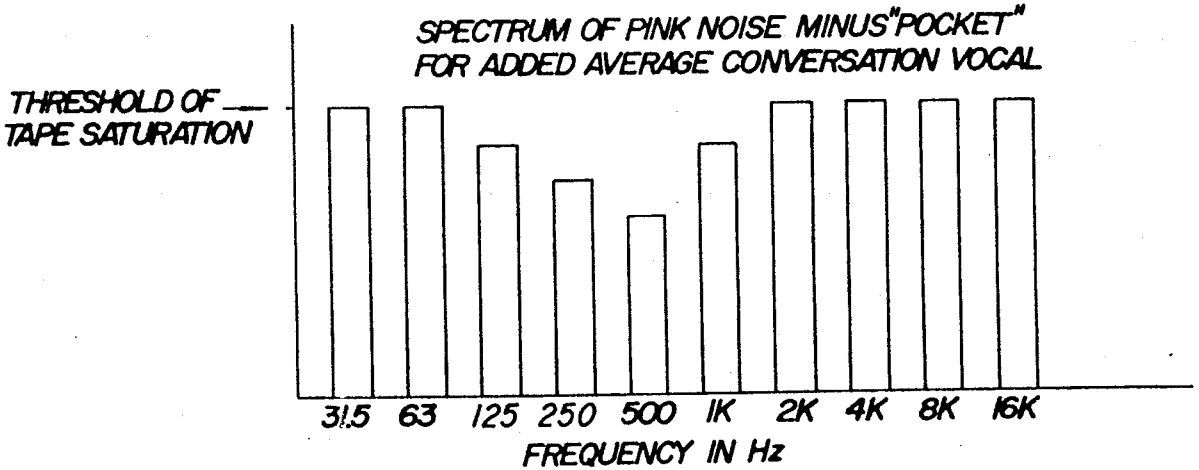
FIG. 3B illustrates a spectrum of pink noise minus a pocket for added averaged conversational vocal signals.

2. Synthesized vocal material, which may or may not be intelligible.
3. Dummy intelligence-bearing sounds, if applicable.
4. Pink noise variant, as shown in FIG. 2. More specifically, pink noise which has been electronically split into a number of frequency bands, each of which is randomly and independently increased or decreased in amplitude, relative to a fixed level, the period between changes being as short as possible while still being feasible. Additionally, the pink noise may have a 20 dB pocket at approximately 500 Hz. FIG. 3A illustrates a typical spectrum of average vocal signals in conversations. In a preferred embodiment, the pocket in the spectrum of the second signal, as illustrated in FIG. 3B, is approximately the pink noise spectrum shown in FIG. 2 minus the spectrum of the average vocal signals of FIG. 3A.

The absolute uniqueness of the first signal and the second signal is assured, when all channels are played back and spatially mixed, along with the target signal, at an appropriate volume relative to the volume of the target signal, so that no one signal of the first signal and second signal may be isolated for electronic assault against any of the other signals. Additionally, the nonsynchronous nature of the playback sources assures the absolute uniqueness of each playback.

Preliminary investigation also has shown that for each system, the minimum number of speakers for playback is four. Use of less than four speakers will not guarantee complete room coverage, and this is necessary for true effectiveness. Arrangement of the speakers during playback also is of prime importance.

The invention's effectiveness increases proportionally with the number of unique signals played back. More signals effectively "confuses" stereo micing and subsequent parametric spectrum subtraction for vocal only, and precludes such electronic treatments as inverted phase addition. Additionally, uniqueness of system playback is assured by the odds against exact replication of individual generating means start-up and playback synchronization.

Part of the signal, as previously mentioned, basically is pink noise. Pink noise, as illustratively shown in FIG. 2, is simply a flat noise spectrum. It tends to overdrive mics and levels, forcing a reduction in recording gain. Such a reduction would render a concurrent vocal comparatively inaudible. By using pink noise with a 20 dB "pocket" centering at about 500 Hz, the vocal range, as shown in FIG. 3B, the spectrum analysis of a surveillance recording, effectively an ambient mix of the pink noise variants, the added dozens of voices, synthesized vocals and dummy intelligence signals, would show only unstable pink noise, and would sound like pink noise with a lot of vocal gibberish. A single or dual vocal would be nearly impossible to extract from such a "noise bath".

The first part of the signal, as shown in FIG. 4, is basically a randomly floating mix of 4 to 8 human voices, one or more synthesized vocal tracks, and one or more dummy intelligence signals. The irregularity of these compound frequencies and the inconsistency of their amplitudes make them nearly impossible to consistently filter, and their presence will further "crowd" the vocal frequency bands, along with the target vocal or vocals.

The pink noise variant part and the voice/synthesized vocal/intelligence signal part are mixed at approximately equal levels. Each generating means therefore generates a mix of all of these components. With two or more, preferably many more, of these signals generated and radiated during conversation or intelligence transmission, the ambient mix created in the environment makes a target signal or signals impossible to extricate, even with such measures as stereo micing, phase array, parametric subtraction, and inverted phase addition, without destroying that target signal in the process.

An additional advantage of the present invention may be gained by the incorporation of a customized voice signal. This would be accomplished by obtaining a sample of the client's voice. This sample would be replicated, and also used as source material for vocal synthesis. The resulting material would be incorporated in the masking signal. Thus, in generation and radiation of the signal, the radiated signal would include dozens of voices and synthesized vocal tracks, all of them identical to the target signal. This would provide protection against voice print filtration.

Minor alteration of the tapes and/or playback units could be made to ensure only intersystem compatibility. This would effectively prohibit the unauthorized dubbing of copies.

The present invention can be used to discourage or foil ambient room bugging during sensitive or classified telephone conversations. The present invention also can be used in conjunction with standard telephone encryption/decryption devices.

It will be apparent to those skilled in the art that various modifications can be made to the audio surveillance discouragement apparatus of the instant invention without departing from the scope or spirit of the invention, and it is intended that the present invention cover modifications and variations of the apparatus provided they come within the scope of the appended claims and their equivalents.

We claim:

1. An audio surveillance discouragement apparatus comprising:

first means for generating a first signal having a plurality of voice signals, synthesized vocal signals, and dummy intelligence signals, mixed with pink noise having a pocket of approximately 20 dB near 500 Hz;

first speaker means coupled to said first generating means for radiating said first signal;

second means for generating a second signal nonsynchronous with said first signal, with the second signal having a plurality of voice signals, synthesized vocal signals, and dummy intelligence signals, mixed with pink noise having a pocket of approximately 20 dB near 500 Hz; and second speaker means coupled to said second generating means for radiating said second signal wherein said first speaker is located a distance from said second speaker and for spatially mixing the radiated first signal with the radiated second signal, respectively.

2. The audio surveillance discouragement apparatus as set forth in claim 1, wherein said first generating means includes a device from the group of magnetic tape recorder, magnetic disc, compact disc, digital audio tape and RAM sampling chip.

3. An audio surveillance discouragement apparatus comprising:

first means for generating a first signal having a plurality of ambient noise signals with frequencies in the vocal frequency band, mixed with pink noise;

first speaker means coupled to said first generating means for radiating said first signal;

second means for generating a second signal nonsynchronous with said first signal, with the second signal having a plurality of ambient noise signals with frequencies in the vocal frequency band, mixed with pink noise; and second speaker means coupled to said second generating means for radiating said second signal wherein said first speaker is located a distance from said second speaker and for spatially mixing the radiated first signal with the radiated second signal, respectively.

4. The audio surveillance discouragement apparatus as set forth in claim 3, wherein said first generating means includes a device from the group of magnetic tape recorder, magnetic disc, compact disc, digital audio tape and RAM sampling chip.

5. An audio surveillance discouragement apparatus comprising:

first means for generating a first signal having a plurality of ambient noise signals with frequencies in the vocal frequency band, mixed with pink noise having a pocket of approximately 20 dB near 500 Hz;

first speaker means coupled to said first generating means for radiating said first signal;

second means for generating a second signal nonsynchronous with said first signal, with the second signal having a plurality of ambient noise signals with frequencies in the vocal frequency band, mixed with pink noise having a pocket of approximately 20 dB near 500 Hz; and second speaker means coupled to said second generating means for radiating said second signal wherein said first speaker is located a distance from said second speaker and for spatially mixing the radiated first signal with the radiated second signal, respectively.

6. The audio surveillance discouragement apparatus as set forth in claim 5, wherein said first generating means includes a device from the group of magnetic tape recorder, magnetic disc, compact disc, digital audio tape and RAM sampling chip.

7. A method using an audio apparatus for discouraging surveillance comprising the steps of:

generating a first signal having a plurality of voice signals, synthesized vocal signals, and dummy intelligence signals, mixed with pink noise;

radiating said first signal using first speaker means;

generating a second signal nonsynchronous with said first signal, with the second signal having a plurality of voice signals, synthesized vocal signals, and dummy intelligence signals, mixed with pink noise; and radiating said second signal using second speaker means wherein said first speaker is located a distance from said second speaker and for spatially mixing the radiated first signal with the radiated second signal, respectively.

8. An audio surveillance discouragement apparatus comprising:

first means for generating a first signal having at least one voice signal, a synthesized vocal signal, and a dummy intelligence signal;

first speaker means coupled to said first generating means for radiating said first signal;

second means for generating a second signal having a pink noise signal; and second speaker means coupled to said second generating means for radiating said second signal.

9. The audio surveillance discouragement apparatus as set forth in claim 8, wherein said first generating means includes a device from the group of magnetic tape recorder, magnetic disc, compact disc, digital audio tape and RAM sampling chip.

10. An audio surveillance discouragement apparatus comprising:

means for generating a first signal having a plurality of synthesized vocal signals mixed with pink noise, and for generating a second signal nonsynchronous with said first signal, with the second signal having a plurality of synthesized vocal signals mixed with pink noise;

first speaker means coupled to said generating means for radiating said first signal; and second speaker means coupled to said generating means for radiating said second signal wherein said first speaker is located a distance from said second speaker and for spatially mixing the radiated first signal with the radiated second signal, respectively.

11. The audio surveillance discouragement apparatus as set forth in claim 10, wherein said generating means includes a device from the group of magnetic tape recorder, magnetic disc, compact disc, digital audio tape and RAM sampling chip.

12. An audio surveillance discouragement apparatus comprising:

means for generating a first signal having a plurality of ambient noise signals each with a center frequency at about the vocal frequency, and for generating a second signal nonsynchronous with said first signal, with the second signal having approximately an amplitude spectrum divided into a plurality of frequency bands with each of said frequency bands randomly and independently increased or decreased in amplitude, with said second signal having approximately a 20 dB pocket near 500 Hz;

first speaker means coupled to said generating means for radiating said first signal; and second speaker means coupled to said generating means for radiating said second signal wherein said first speaker is located a distance from said second speaker and for spatially mixing the radiated first signal with the radiated second signal, respectively.

13. The audio surveillance discouragement apparatus as set forth in claim 12, wherein said generating means includes a device from the group of magnetic tape recorder, magnetic disc, compact disc, digital audio tape and RAM sampling chip.

14. An audio surveillance discouragement apparatus comprising:

means for generating a first signal having a plurality of ambient noise signals with frequencies in the vocal frequency band and a plurality of frequency bands with noise signals in said frequency bands having randomly and independently varying amplitudes, and for generating a second signal nonsynchronous with said first signal, with the second signal having a plurality of ambient noise signals with frequencies in the vocal frequency band and a plurality of frequency bands with noise signals in said frequency bands having randomly and independently varying amplitudes;

first speaker means coupled to said generating means for radiating said first signal; and second speaker means coupled to said generating means for radiating said second signal wherein said first speaker is located a distance from said second speaker and for spatially mixing the radiated first signal with the radiated second signal, respectively.

15. The audio surveillance discouragement apparatus as set forth in claim 14, wherein said generating means includes a device from the group of magnetic tape recorder, magnetic disc, compact disc, digital audio tape and RAM sampling chip.

16. An audio surveillance discouragement apparatus comprising:

means for generating a first signal having at least one voice signal, a synthesized vocal signal, and a dummy intelligence signal, and for generating a second signal having a pink noise signal;

first speaker means coupled to said generating means for radiating said first signal; and second speaker means coupled to said generating means for radiating said second signal.

17. The audio surveillance discouragement apparatus as set forth in claim 16, wherein said generating means includes a device from the group of magnetic tape recorder, magnetic disc, compact disc, digital audio tape and RAM sampling chip.

18. An audio surveillance discouragement apparatus, comprising:

first means for generating a first signal having a plurality of dummy intelligence signals, mixed with pink noise;

first speaker means coupled to said first generating means for radiating said first signal;

second means for generating a second signal nonsynchronous with said first signal, with the second signal having at least pink noise; and second speaker means coupled to said second generating means for radiating said second signal wherein said first speaker is located a distance from said second speaker and for spatially mixing the radiated first signal with the radiated second signal, respectively.

19. The audio surveillance discouragement apparatus of claim 18, wherein said second signal also has a plurality of dummy intelligence signals.

20. The audio surveillance discouragement apparatus of claim 19, wherein said pink noise has a pocket of approximately 20 dB near 500 KHz.

* * * * *